US010590579B2

(12) United States Patent
Okuyama et al.

(10) Patent No.: US 10,590,579 B2
(45) Date of Patent: Mar. 17, 2020

(54) SEWING MACHINE AND NON-TRANSITORY COMPUTER-READABLE MEDIUM

(71) Applicant: BROTHER KOGYO KABUSHIKI KAISHA, Nagoya-shi, Aichi-ken (JP)

(72) Inventors: Tsuneo Okuyama, Inabe-gun (JP); Aki Yokoyama, Nagakute (JP); Mika Matsushima, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 245 days.

(21) Appl. No.: 15/716,002

(22) Filed: Sep. 26, 2017

(65) Prior Publication Data

US 2018/0016720 A1 Jan. 18, 2018

Related U.S. Application Data

(63) Continuation of application No. PCT/JP2016/072302, filed on Jul. 29, 2016.

(30) Foreign Application Priority Data

Sep. 30, 2015 (JP) ..... 2015-194367

(51) Int. Cl.
*D05B 19/12* (2006.01)
*D05B 55/16* (2006.01)
(Continued)

(52) U.S. Cl.
CPC ..... *D05B 19/12* (2013.01); *D05B 19/085* (2013.01); *D05B 55/16* (2013.01); *D05C 5/02* (2013.01)

(58) Field of Classification Search
CPC ..... D05B 19/00; D05B 19/02; D05B 19/04; D05B 19/08; D05B 19/10; D05B 19/12; D05C 5/02
See application file for complete search history.

(56) References Cited

U.S. PATENT DOCUMENTS 5,228,402 A * 7/1993 Sugimoto ..... D05B 19/105 112/102.5
5,228,403 A * 7/1993 Sugimoto ..... D05B 19/10 112/102.5
(Continued)

FOREIGN PATENT DOCUMENTS

JP H09-155088 A 6/1997
JP 2004-033538 A 2/2004
(Continued)

OTHER PUBLICATIONS

Apr. 3, 2018 International Preliminary Report on Patentability issued in International Patent Application No. PCT/JP2016/072302.
(Continued)

*Primary Examiner* — Nathan E Durham
(74) *Attorney, Agent, or Firm* — Oliff PLC

(57) ABSTRACT

A sewing machine includes needle bars, a notification portion, a processor, and a memory. The memory is configured to store computer-readable instructions that, when executed by the processor, instruct the processor to perform processes. The processes include acquiring sewing data for sewing an embroidery pattern made up of a plurality of partial pattern, setting correspondences between a needle bar among the needle bars and an upper thread data set included in the sewing data, for each of the needle bars, and the sewing embroidery pattern, detecting an error that occurs during the sewing, stopping the sewing when the error is detected, specifying a change-eligible needle bar, for which the sewing is completed, when a target data set exists, the correspondence with one of the needle bars not being set for the target data set, and causing the notification portion to notify information indicating the specified change-eligible needle bar.

13 Claims, 10 Drawing Sheets

(51) Int. Cl.
*D05C 5/02* (2006.01)
*D05B 19/08* (2006.01)

(56) References Cited

U.S. PATENT DOCUMENTS 5,267,518 A * 12/1993 Arnold ..... D05B 59/02 112/273
5,904,109 A * 5/1999 Asano ..... D05B 19/12 122/102.5
6,012,402 A * 1/2000 Sekine ..... D05B 19/105 112/102.5
6,237,516 B1 * 5/2001 Wakayama ..... D05B 19/105 112/102.5
6,863,007 B2 * 3/2005 Fluckiger ..... B65H 63/082 112/278
8,428,764 B2 * 4/2013 Nagai ..... D05B 19/12 700/138
8,909,366 B2 * 12/2014 Okuyama ..... D05C 11/16 112/470.01
2005/0283268 A1 * 12/2005 Hagino ..... D05B 19/10 700/138
2006/0021556 A1 2/2006 Asai et al.
2006/0200268 A1 * 9/2006 Hayakawa ..... D05B 19/10 700/136
2007/0272136 A1 11/2007 Shimizu
2009/0020054 A1 * 1/2009 Taguchi ..... D05B 19/10 112/103
2010/0313803 A1 * 12/2010 Okuyama ..... D05B 19/12 112/102.5
2011/0203504 A1 8/2011 Nagai et al.

FOREIGN PATENT DOCUMENTS

JP 2005-073866 A 3/2005
JP 2006-034677 A 2/2006
JP 2007-313159 A 12/2007
JP 2009-090046 A 4/2009
JP 2011-167446 A 9/2011

OTHER PUBLICATIONS

Oct. 25, 2016 Search Report issued in International Patent Application No. PCT/JP2016/072302.

* cited by examiner

FIG. 4

51

| SEWING ORDER | UPPER THREAD DATA | COORDINATE DATA |
|---|---|---|
| 1 | WHITE | ··· |
| 2 | BLUE | ··· |
| 3 | YELLOW | ··· |
| 4 | ORANGE | ··· |
| 5 | RED | ··· |
| 6 | BLACK | ··· |
| 7 | PINK | ··· |
| 8 | VIOLET | ··· |
| 9 | GREEN | ··· |

CT

52

| SEWING ORDER | NEEDLE BAR NUMBER | UPPER THREAD DATA |
|---|---|---|
| 1 | 1 | WHITE |
| 2 | 2 | BLUE |
| 3 | 3 | YELLOW |
| 4 | 4 | ORANGE |
| 5 | 5 | RED |
| 6 | 6 | BLACK |
| 7 | 1 | PINK |
| 8 | 2 | VIOLET |
| 9 | 3 | GREEN |

53

| NEEDLE BAR NUMBER | UPPER THREAD DATA |
|---|---|
| 1 | WHITE |
| 2 | BLUE |
| 3 | YELLOW |
| 4 | ORANGE |
| 5 | RED |
| 6 | BLACK |

54

| NEEDLE BAR NUMBER | UPPER THREAD DATA |
|---|---|
| 1 | PINK |
| 2 | VIOLET |
| 3 | GREEN |
| 4 | ORANGE |
| 5 | RED |
| 6 | BLACK |

SEWING MACHINE AND NON-TRANSITORY COMPUTER-READABLE MEDIUM

CROSS-REFERENCE TO RELATED APPLICATION

This application is a continuation application of International Application No. PCT/JP2016/072302, filed Jul. 29, 2016, which claims priority from Japanese Patent Application No. 2015-194367, filed on Sep. 30, 2015. The disclosure of the foregoing application is hereby incorporated by reference in its entirety.

BACKGROUND

The present disclosure relates to a sewing machine that is provided with a plurality of needle bars and to a non-transitory computer-readable medium.

A sewing machine that is provided with a plurality of needle bars is known. For each one of a plurality of partial patterns that make up an embroidery pattern, the multi-needle sewing machine acquires a number n, which is the number of stitches that are required in order to sew the partial pattern. The multi-needle sewing machine is configured to allocate a plurality of upper threads to the plurality of the needle bars, based on the acquired number n, such that the numbers of stitches that are allocated among the plurality of the needle bars are not distributed unevenly.

SUMMARY

The known sewing machine is able to change the threads only at specific times that are set by a user when sewing starts.

Various embodiments of the broad principles derived herein provide a sewing machine and a non-transitory computer-readable medium that can make it more convenient for the user to sew an embroidery pattern that is sewn using a plurality of the types of the upper threads.

Embodiments provide a sewing machine that includes a plurality of needle bars, a notification portion, a processor, and a memory. The memory is configured to store computer-readable instructions that, when executed by the processor, instruct the processor to perform processes. The processes include acquiring sewing data for sewing an embroidery pattern that is made up of a plurality of partial patterns, the sewing data including a plurality of upper thread data sets specifying types of upper threads associated with individual ones of the plurality of the partial patterns. The processes include setting correspondences between a needle bar from among the plurality of the needle bars and an upper thread data set included in the acquired sewing data, for each of the plurality of the needle bar. The processes include sewing each of the plurality of the partial patterns on a workpiece by operating, from among the plurality of the needle bars, a needle bar for which the correspondence with the upper thread data set is set. The processes include detecting an error that occurs during the sewing of each of the plurality of the partial patterns. The processes include stopping the sewing of a partial pattern being sewn in a case where the error is detected. The processes include specifying a change-eligible needle bar, which is one of the plurality of the needle bars and for which the sewing is completed, in a case where a target data set exists among the plurality of the upper thread data sets included in the sewing data, the correspondence with one of the plurality of the needle bars not being set for the target data set. The processes include causing the notification portion to notify information that indicates the specified change-eligible needle bar in a case where the error is detected.

Embodiments further provide a non-transitory computer-readable medium that stores computer-readable instructions that are executed by a processor of a sewing machine provided with a plurality of needle bars and a notification portion, the computer-readable instructions, when executed, instructing the processor to perform processes. The processes include acquiring sewing data for sewing an embroidery pattern that is made up of a plurality of partial patterns, the sewing data including a plurality of upper thread data sets specifying types of upper threads associated with individual ones of the plurality of the partial patterns. The processes include setting correspondences between a needle bar from among the plurality of the needle bars and an upper thread data set included in the acquired sewing data, for each of the plurality of the needle bar. The processes include sewing each of the plurality of the partial patterns on a workpiece by operating, from among the plurality of the needle bars, a needle bar for which the correspondence with the upper thread data set is set. The processes include detecting an error that occurs during the sewing of each of the plurality of the partial patterns. The processes include stopping the sewing of a partial pattern being sewn in a case where the error is detected. The processes include specifying a change-eligible needle bar, which is one of the plurality of the needle bars and for which the sewing is completed, in a case where a target data set exists among the plurality of the upper thread data sets included in the sewing data, the correspondence with one of the plurality of the needle bars not being set for the target data set. The processes include causing the notification portion to notify information that indicates the specified change-eligible needle bar in a case where the error is detected.

BRIEF DESCRIPTION OF THE DRAWINGS

Embodiments will be described below in detail with reference to the accompanying drawings in which:

FIG. 4 is a conceptual diagram of sewing data, an allocation table, and a needle bar setting table;

DETAILED DESCRIPTION

Hereinafter, an embodiment of the present disclosure will be explained with reference to the drawings. A physical configuration of a multi-needle sewing machine (hereinafter simply called the sewing machine) 1 according to the present embodiment will be explained with reference to FIG. 1. In the explanation that follows, the upper side, the lower side, the lower left side, the upper right side, the upper left side, and the lower right side in FIG. 1 respectively correspond to the upper side, the lower side, the front side, the rear side, the left side, and the right side of the sewing machine 1.

Figure 1:
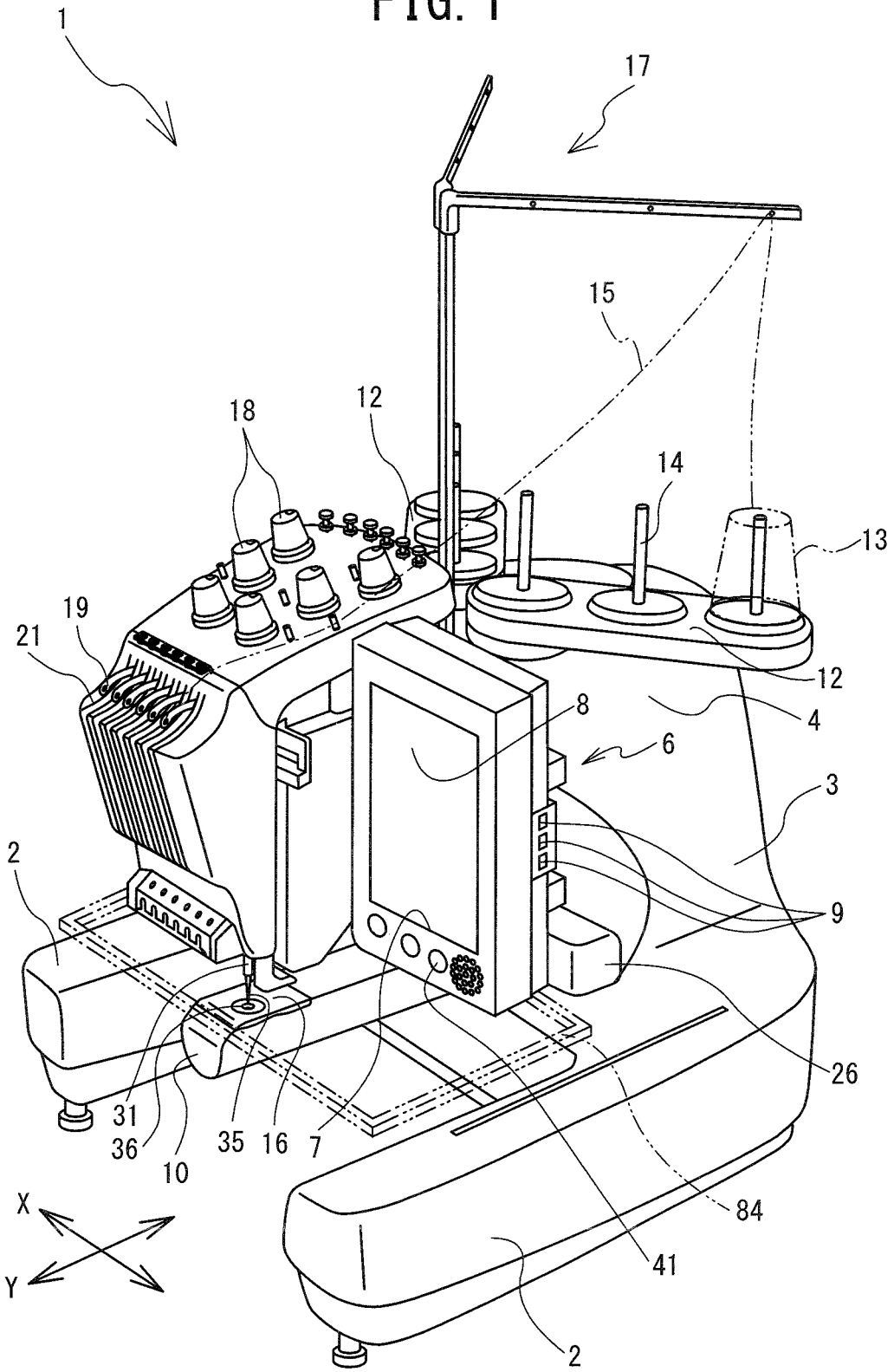
FIG. 1 is a perspective view of a sewing machine.

As shown in FIG. 1, the sewing machine 1 is provided with a support portion 2, a pillar 3, and an arm 4. The support portion 2 supports the entire sewing machine 1. The pillar 3 extends vertically upward from the rear end of the support portion 2. The arm 4 extends toward the front from the upper end portion of the pillar 3. A needle bar case 21 is attached to the front end of the arm 4 such that the needle bar case 21 can move in a left-right direction. Six needle bars 31 that extend in the up-down direction are disposed at equal intervals in the left-right direction in the interior of the needle bar case 21. A needle bar number is assigned to each one of the six needle bars 31 in order to identify the individual needle bars 31. In the present embodiment, the needle bar numbers 1 to 6 are assigned in order, starting from the right side of the sewing machine 1. Among the six needle bars 31, the one needle bar 31 that is in a sewing position (the sewing needle bar) is moved up and down by a needle bar drive mechanism 32 (refer to FIG. 2). The needle bar drive mechanism 32 is provided in the interior of the needle bar case 21. A sewing needle 35 can be mounted on the lower end of the needle bar 31.

An operation portion 6 is provided on the arm 4. The operation portion 6 is provided with a liquid crystal display (LCD) 7, a touch panel 8, a connector 9, and a start/stop switch 41. Various types of information that are used when a user inputs a command, for example, may be displayed on the LCD 7 an operation screen. The touch panel 8 is used for accepting commands from the user. The user is able to select and set various types of conditions, such as a sewing pattern and sewing conditions, by using a finger or a stylus pen to press a position on the touch panel 8 that corresponds to the position of an input key or the like that is displayed on the LCD 7. Hereinafter, when the user uses a finger or a stylus pen to press a position on the touch panel 8, the operation of doing so will be called a panel operation. The connector 9 is a USB-compliant connector, and the connector 9 can be connected to a USB device 160 (refer to FIG. 2). The start/stop switch 41 is used for issuing commands to start and stop sewing. If the start/stop switch 41 is pressed while the sewing is stopped, the sewing is started. If the start/stop switch 41 is pressed while the sewing is in progress, the sewing is stopped.

A tube-shaped cylinder head 10 that extends toward the front from the lower end of the pillar 3 is provided below the arm 4. A shuttle (not shown in the drawings) is provided in the interior of the front end of the cylinder head 10. The shuttle may accommodate a bobbin (not shown in the drawings), around which a lower thread (not shown in the drawings) is wound. A shuttle drive mechanism (not shown in the drawings), and a lower thread sensor 37 are provided in the interior of the cylinder head 10. The shuttle drive mechanism (not shown in the drawings) is configured to rotationally drive the shuttle. The lower thread sensor 37 is a known sensor that detects that the lower thread has been consumed and has run out (for example, refer to Japanese Laid-Open Patent Publication No. 2006-34677, relevant portions of which are herein incorporated by reference). A needle plate 16, which is rectangular in a plan view, is provided on the top face of the cylinder head 10. A needle hole 36, through Which the sewing needle 35 may pass, is provided in the needle plate 16. Among the six needle bars 31, the one needle bar 31 that is positioned in the sewing position, which is directly above the needle hole 36, is the sewing needle bar.

A Y carriage 26 of an embroidery frame movement mechanism 11 (refer to FIG. 2) is provided below the arm 4. The embroidery frame movement mechanism 11 may support an embroidery frame 84 such that the embroidery frame 84 can be mounted and removed. The embroidery frame 84 may hold the workpiece C (a work cloth, for example). The embroidery frame movement mechanism 11 is configured to move the embroidery frame 84 toward the front and the rear and toward the left and the right, using an X axis motor 132 (refer to FIG. 2) and a Y axis motor 134 (refer to FIG. 2) as drive sources.

Figure 2:
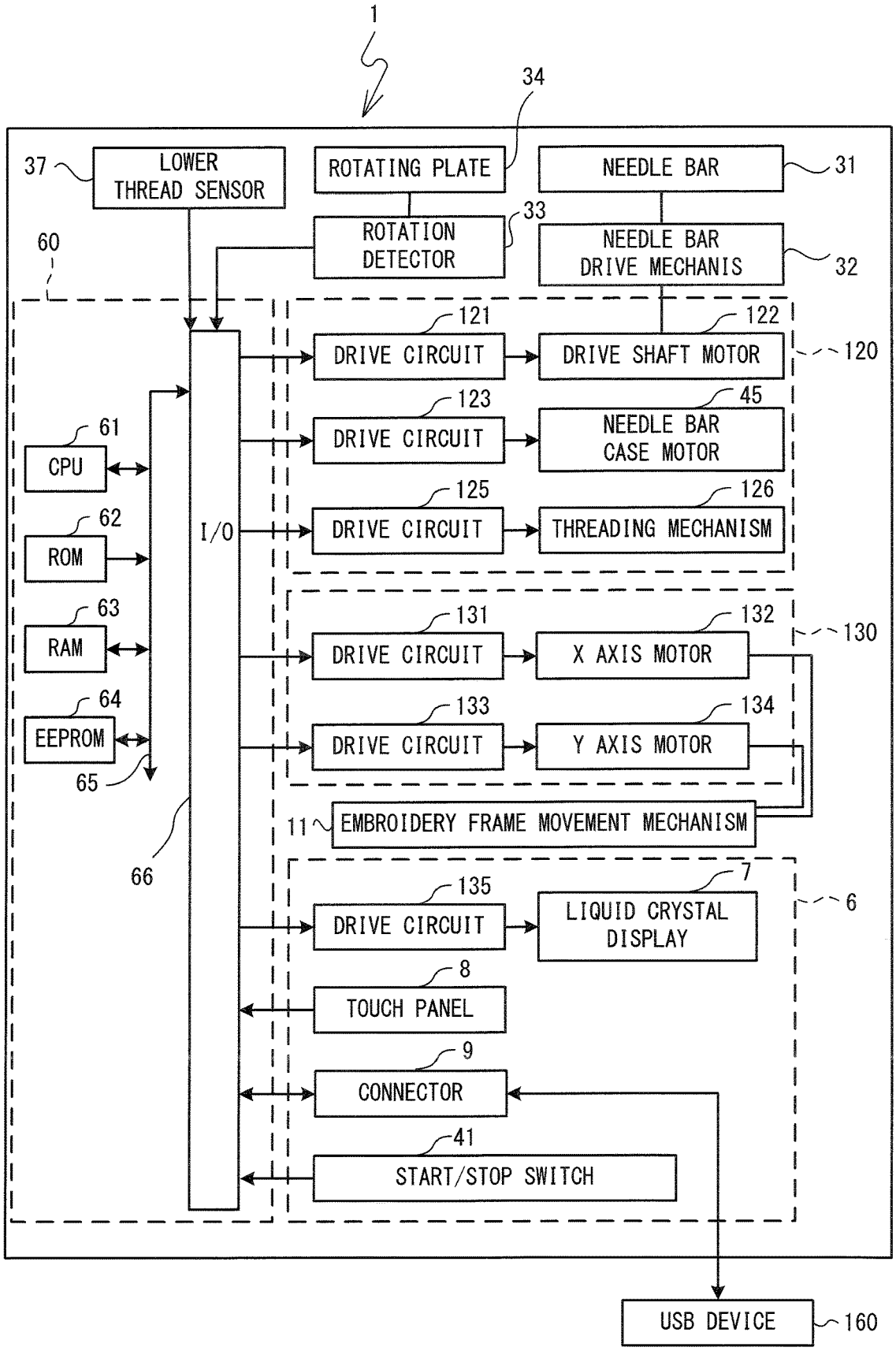
FIG. 2 is a block diagram showing an electrical configuration of the sewing machine.

A left-right pair of thread spool holders 12 are provided on the rear side of the top face of the arm 4. Three thread spool pins 14 are provided on each of the thread spool holders 12. The thread spool pins 14 are pins that extend in the up-down direction. The thread spool pins 14 may support thread spools 13. Six thread spools 13, the same number as the number of the needle bars 31, can be disposed on the pair of the thread spool holders 12. The upper threads 15 may be supplied from the thread spools 13 that are disposed on the thread spool holders 12. The upper threads 15 may be supplied through thread guide paths to the eyes (not shown in the drawings) of the corresponding sewing needles 35 that are mounted on the lower ends of the needle bars 31. The thread guide paths include thread guides 17, tensioners 18, and thread take-up levers 19. Although details are not shown in the drawings, the tensioner 18 is provided in its interior with a rotating plate 34 and a rotation detector 33 that are shown in FIG. 2. The tensioner 18 has a known configuration that is described in Japanese Laid-Open Patent Publication No. 2007-313159, for example, relevant portions of Which are herein incorporated by reference. The rotating plate 34 may impart tension to the upper thread 15. The rotation detector 33 may input to the control portion 60 (refer to FIG. 2) an electrical signal that indicates the amount of rotation in the rotating plate 34.

The electrical configuration that performs overall control of the sewing machine 1 will be explained with reference to FIG. 2. As shown in FIG. 2, the sewing machine 1 is provided with the rotation detector 33, the lower thread sensor 37, a sewing needle drive portion 120, a sewn object drive portion 130, the operation portion 6, and the control portion 60.

The sewing needle drive portion 120 is provided with drive circuits 121, 123, 125, a drive shaft motor 122, a needle bar case motor 45, and a threading mechanism 126. The drive shaft motor 122 may move the sewing needle bar reciprocally up and down by operating the needle bar drive mechanism 32. The drive circuit 121 may drive the drive shaft motor 122 in accordance with a control signal from the control portion 60. The needle bar case motor 45 may cause the needle bar case 21 to move in the left-right direction. The drive circuit 123 may drive the needle bar case motor 45 in accordance with a control signal from the control portion 60. Although details are not shown in the drawings, the threading mechanism 126 is provided below the front end of the arm 4. The threading mechanism 126 is used for inserting the upper thread 15 (refer to FIG. 1) into the eye of the sewing needle 35 on the sewing needle bar. The threading mechanism 126 has a known configuration (refer, for example, to Japanese Laid-Open Patent Publication No. 2005-73866, relevant portions of which are herein incorporated by reference). The drive circuit 125 may drive the threading mechanism 126 in accordance with a control signal from the control portion 60.

The sewn object drive portion 130 is provided with drive circuits 131, 133, the X axis motor 132, and the Y axis motor 134. The X axis motor 132 may move the embroidery frame 84 in the left-right direction by driving the embroidery frame movement mechanism 11. The drive circuit 131 may drive the X axis motor 132 in accordance with a control signal from the control portion 60. The Y axis motor 134 may move the embroidery frame 84 in the front-rear direction by driving the embroidery frame movement mechanism 11. The drive circuit 133 may drive the Y axis motor 134 in accordance with a control signal from the control portion 60.

The operation portion 6 is provided with the touch panel 8, the connector 9, a drive circuit 135, the LCD 7, and the start/stop switch 41. The drive circuit 135 may drive the LCD 7 in accordance with a control signal from the control portion 60. The connector 9 is provided with a function that connects with the USB device 160. The USB device 160 may be a PC or a USB memory, for example.

The control portion 60 is provided with a CPU 61, a ROM 62, a RAM 63, an EEPROM (registered trademark) 64, and an input/output interface (I/O) 66, all of which are connected by a bus 65. The I/O 66 is also connected to the rotation detector 33, the lower thread sensor 37, the sewing needle drive portion 120, the sewn object drive portion 130, and the operation portion 6.

The CPU 61 is configured to perform the main control of the sewing machine 1. In accordance with various types of programs that may be stored in a program storage area (not shown in the drawings) of the ROM 62, the CPU 61 may perform various types of computations and processing that pertain to sewing. The ROM 62 is provided with a plurality of storage areas, including the program storage area and a pattern storage area, which are not shown in the drawings. Various types of programs for operating the sewing machine 1, including a main program, are stored in the program storage area. The main program is a program for performing main processing, which will be described later. Sewing data are stored in the pattern storage area. The sewing data and embroidery patterns will be explained later. The RAM 63 is a storage element to and from which data can be written and read as desired. The RAM 63 is provided as necessary with storage areas that contain computation results and the like from computational processing that the CPU 61 performs. The EEPROM 64 is a storage element to and from which data can be written and read as desired. Various types of parameters for performing various types of processing for the sewing machine 1 are stored in the EEPROM 64.

An operation that forms stitches on the workpiece C that is held by the embroidery frame 84 will be explained with reference to FIGS. 1 and 2. The embroidery frame 84 that holds the workpiece C is supported by the embroidery frame movement mechanism 11. One of the six needle bars 31 is selected by moving the needle bar case 21 to the left or the right. The embroidery frame 84 is moved to a specified position by the embroidery frame movement mechanism 11. When the drive shaft (not shown in the drawings) is rotationally driven by the drive shaft motor 122, the needle bar drive mechanism 32 and a thread take-up lever drive mechanism (not shown in the drawings) are driven such that the selected needle bar 31 and the corresponding thread take-up lever 19 are driven up and down. The shuttle drive mechanism is also driven by the rotation of the drive shaft motor 122, such that the shuttle is rotationally driven. The sewing needle 35, the thread take-up lever 19, and the shuttle are thus driven in synchronized manner, such that stitches are formed on the workpiece C.

Figure 3:
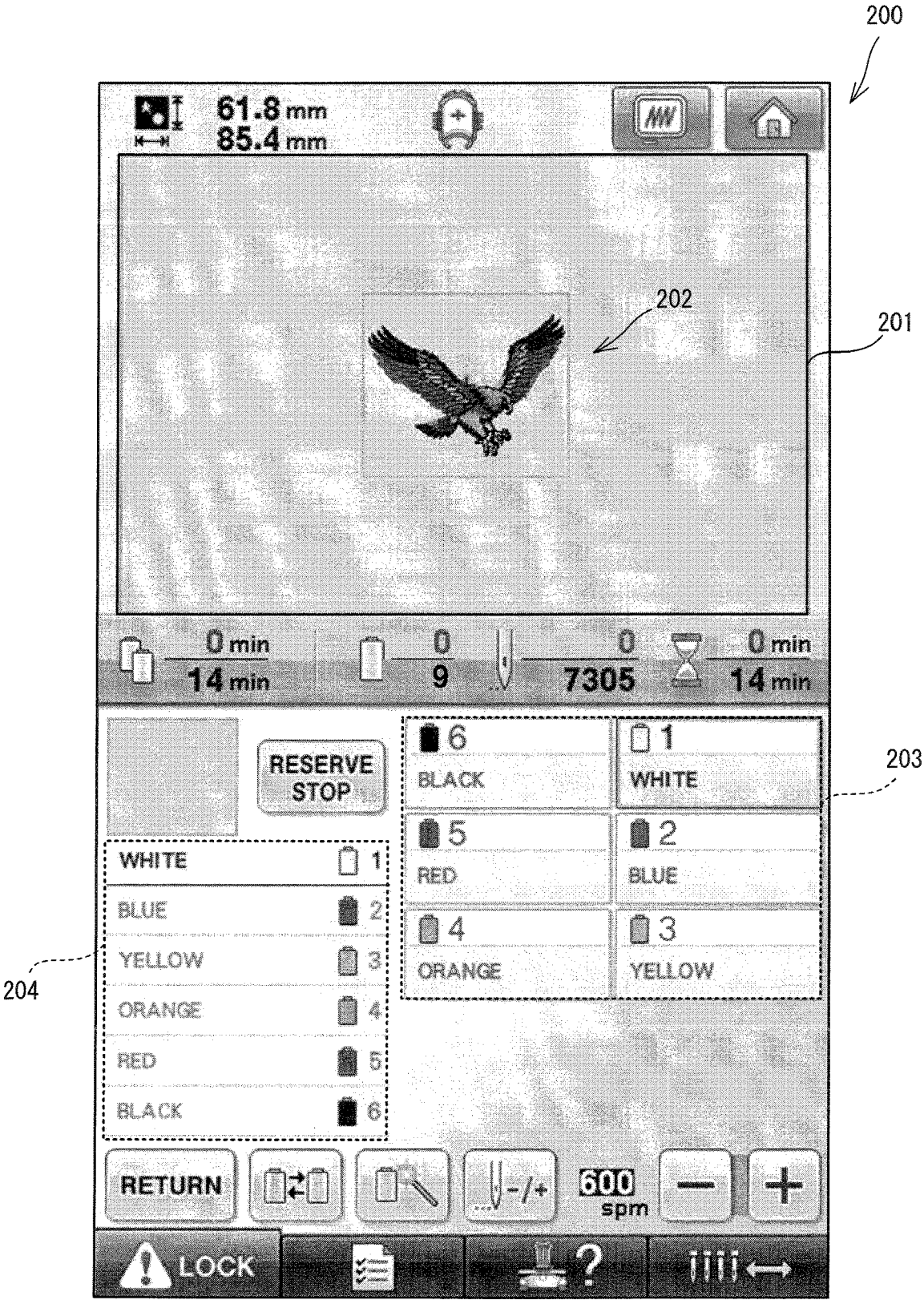
FIG. 3 is an explanatory figure of a screen that is displayed when an embroidery pattern is selected.

An embroidery pattern 202 and a screen 200 will be explained with reference to FIG. 3. The embroidery pattern 202 is a pattern of a bird that is sewn using nine different colors of the upper threads 15. The embroidery pattern 202 is made up of nine partial patterns, that is, one partial pattern for each color of the upper threads 15. The screen 200 is displayed on the LCD 7 after a selection command has been input that selects the embroidery pattern 202 as the embroidery pattern that is to be sewn. The screen 200 includes a pattern display area 201, an upper thread display area 203, and a sewing order display area 204. The pattern display area 201 displays the embroidery pattern 202 that has been specified by the selection command. In the sewing order display area 204; the colors of the upper threads 15 for the individual partial patterns of the embroidery pattern 202 are displayed in the sewing order for the partial patterns. The sewing order display area 204 displays the colors of the upper threads 15 for six of the partial patterns, the same as the number of the needle bars 31. The colors of the upper threads 15 for the seventh and subsequent partial patterns in the sewing order are omitted from the display. As shown in the sewing order display area 204, the partial patterns of the embroidery pattern 202 are sewn in the order of white, blue, yellow, orange, red, and black. The upper thread display area 203 displays the upper thread data that have been set for each one of the needle bars 31. The upper thread data that have been set for the needle bars 31 indicate the types of the upper threads 15 that are supplied to the eyes of the sewing needles 35 that are mounted on the needle bars 31. The types of the upper threads 15 may indicate, for example, the colors, the thicknesses, the materials, or the like of the upper threads 15. In the present example, the type of the upper thread 15 is the color of the upper thread 15.

Sewing data 51, an allocation table 52, and a needle bar setting table 53 will be explained with reference to FIG. 4. The sewing data 51 are data for sewing an embroidery pattern that is made up of a plurality of partial patterns, in the present example being data for sewing the embroidery pattern 202 in FIG. 3. The sewing data 51 include the sewing order, the upper thread data, and coordinate data for each one of the nine partial patterns for the different colors of the upper threads 15. The sewing order describes the order in which each one of the partial patterns will be sewn. The upper thread data indicate the type of the upper thread 15 that is associated with each one of the plurality of the partial patterns. The coordinate data are data for specifying the positions of the needle drop points in the partial pattern. The allocation table 52 describes the correspondences between an upper thread data included in sewing data set and a needle bar, from among the six needle bar, for each of the needle bar number, in a case where the embroidery pattern 202 is sewn according to the sewing data 51. The needle bar setting table 53 describes the type of the upper thread 15 that is set for each one of the plurality of the needle bars 31 and is supplied to the sewing needle 35 that is mounted on the lower end of each one of the plurality of the needle bars 31. In the needle bar setting table 53, one of the upper thread data sets is set for each one of the needle bars 31, based on allocation table 52. The needle bar setting table 53 may be stored in the EEPROM 64, for example. The needle bar setting table 53 is updated every time the upper thread 15 is switched by the user.

The main processing that the sewing machine 1 performs will be explained with reference to FIGS. 5 to 10. In the main processing, processing is performed in order to sew an embroidery pattern on the workpiece (not shown in the drawings) that is held in the embroidery frame 84. The main processing is started in a case where the selection command has been input. Information that pertains to the embroidery pattern (for example, the sewing data) is stored in the ROM 62, for example, and is displayed on the LCD 7. As an example, a case will be explained in which the selection command has been input for the embroidery pattern 202. At the time when the main processing is started, the upper threads 15 with the colors that are indicated in the needle bar setting table 53 in FIG. 4 are respectively associated with the needle bars 31 with the needle bar numbers 1 to 6. The program that performs the individual processes that are shown in the flowchart in FIG. 5 is stored in the ROM 62 that is shown in FIG. 2 and is executed by the CPU 61.

Figure 5:
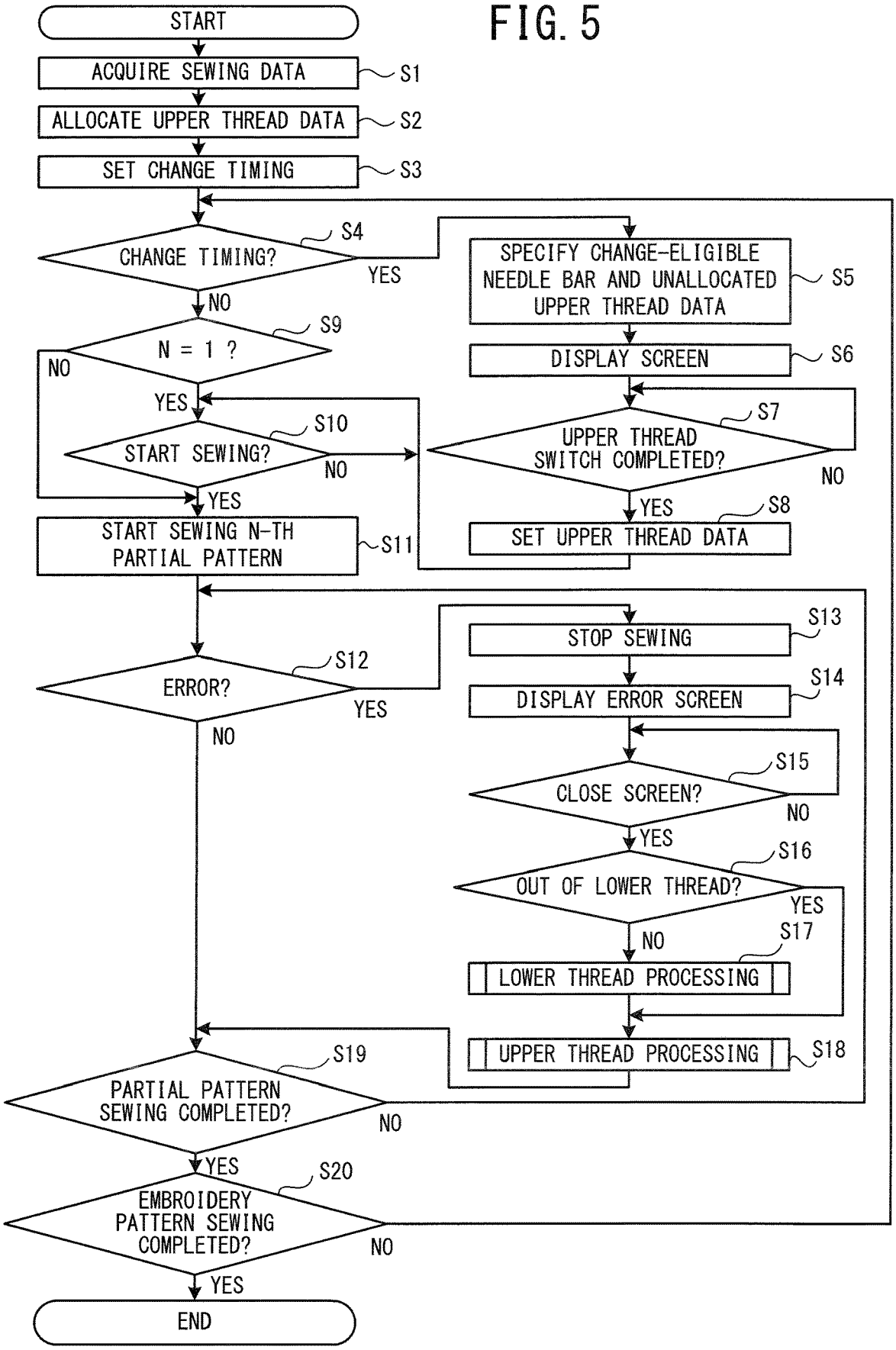
FIG. 5 is a flowchart of main processing.
Figure 6:
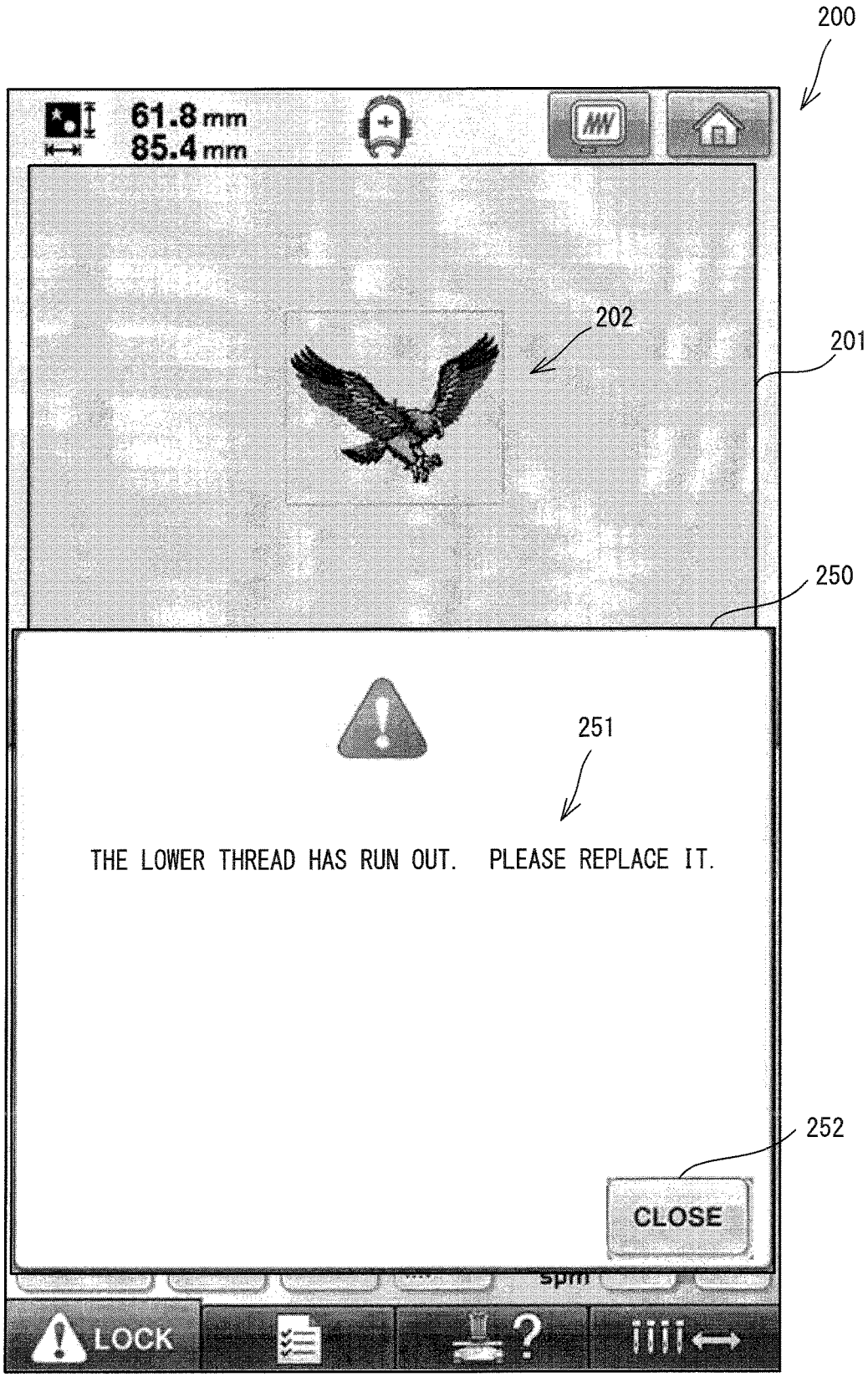
FIG. 6 is an explanatory figure of a screen.

As shown in FIG. 5, the CPU 61 acquires from the ROM 62 the sewing data 51 (refer to FIG. 4) for the embroidery pattern 202 that is specified by the selection command and sets a variable N to 1 (Step S1). The variable N is a variable for acquiring the upper thread data and the coordinate data in accordance with the sewing order, in order to sew the partial patterns. The CPU 61 takes individual sets of the upper thread data that are contained in the sewing data 51 and allocates them to specific ones of the plurality of the needle bars 31 (Step S2). In a case where the types of the upper threads 15 that are currently allocated have been set in the needle bar setting table 53 in the EEPROM 64, the CPU 61 compares the needle bar setting table 53 and the sewing data 51. Then, taking the currently allocated upper threads 15 into account, the CPU 61 allocates the individual sets of the upper thread data that are contained in the sewing data 51 to specific ones of the plurality of the needle bars 31 such that the number of the upper threads 15 (the thread spools 13) that will need to be switched is as low as possible. The CPU 61 then creates the allocation table 52. The CPU 61 causes the LCD 7 to display the screen 200. The display in the sewing order display area 204 is based on the allocation table 52. The display in the upper thread display area 203 is based on the needle bar setting table 53 that is stored in the EEPROM 64.

The CPU 61 sets a change timing (Step S3). The change timing is the timing at which a change is made to the correspondence between one of the upper thread data sets and one of the needle bars 31, which is stored in the needle bar setting table 53. In a case where, before the sewing starts, any one of the upper thread data sets for which the sewing order is from 1 to 6 has not been set for one of the plurality of the needle bars 31, the change timing is set to before the sewing starts. If the change timing is set to a time after the sewing stats, the change timing is set to a time after an M-th partial pattern in the sewing order has been sewn and before an (M+1)-th partial pattern is sewn. M is an integer not less than 1. In other words, the change timing is set to the time when the partial pattern that the sewing machine 1 will be sewing is changed. When the time for the change arrives, the user changes the type of the upper thread 15 that is supplied to the sewing needle 35 that is mounted on the needle bar 31. In other words, the user performs switching of the upper thread 15. In the specific example of the embroidery pattern 202, nine types of the upper threads 15 are used, which is more than the number of the needle bar 31 in the sewing machine 1. Accordingly, the CPU 61 sets a change timing CT between the sixth and the seventh partial patterns in the sewing order, as shown in the allocation table 52 in FIG. 4.

The CPU 61 determines whether or not the current time, which is immediately prior to the sewing of the N-th partial pattern, has reached the change timing CT (Step S4). In a case where N is 1, the current time has not reached the change timing CT (NO at Step S4). In that case, the CPU 61 determines whether or not N is 1 (Step S9). In a case where N is not 1 (NC) at Step S9), the CPU 61 performs the processing at Step S11, which will be described later. In a case where N is 1 (YES at Step S9), the CPU 61 determines whether or not a sewing start command from the start/stop switch 41 has been detected (Step S10). The CPU 61 waits until the sewing start command is detected (NO at Step S10). In a case where the sewing start command is detected (YES at Step S10), the CPU 61 performs processing that sews the N-th partial pattern on the workpiece by operating the needle bar 31 for which the upper thread data for the N-th partial pattern have been set (Step S11). By outputting a control signal to the drive circuit 123, the CPU 61 moves the needle bar 31 that is associated with the upper thread data for the N-th partial pattern to the sewing position, which is located directly above the needle hole 36. In accordance with the coordinate data for the N-th partial pattern, the CPU 61 moves the embroidery frame 84 by outputting control signals to the drive circuit 131 and the drive circuit 133. The CPU 61 outputs a control signal to the drive circuit 121 to operate the drive shaft motor 122 in synchronization the moving of the embroidery frame 84. The N-th partial pattern is thus sewn. During the sewing processing, the CPU 61 starts processing that updates, at specified intervals (for example, 100 milliseconds), a sewing time T that is stored in the EEPROM 64.

The CPU 61 determines whether or not an error has been detected (Step S12). The error may be that the upper thread 15 has run out or the lower thread has run out, for example. If the upper thread 15 has run out, it is detected based on the signal that is output from the rotation detector 33. If the lower thread has run out, it is detected based on a signal that is output from the lower thread sensor 37. In a case where an error has not been detected (NO at Step S12), the CPU 61 performs the processing at Step S19, which will be described later.

In a case where an error has been detected (YES at Step S12), the CPU 61 stops the sewing of the N-th partial pattern (Step S13). The CPU 61 stops the moving of the embroidery frame 84 and the operating of the needle bar 31 by outputting control signals to the drive circuit 131, the drive circuit 133, and the drive circuit 121. The CPU 61 stops the processing that updates the sewing time T that is stored in the EEPROM 64. The CPU 61 causes the LCD 7 to display a screen that indicates to the effect that an error has occurred (Step S14). For example, the CPU 61 may cause the LCD 7 to display a screen 250 in FIG. 6 on the front face of the screen 200. The screen 250 includes a message area 251 and an input key 252. The message area 251 is an area that displays a message in accordance with the nature of the error, for example, "The lower thread has run out. Please replace it." The screen 250 is displayed for at least as long as the error is detected. The input key 252 is a key that inputs a command to close the screen 250. Referring to the message area 251, the user performs a task that is appropriate to the nature of the error (for example, replacing the lower thread), then selects the input key 252. The CPU 61 waits until the selecting of the input key 252 has been detected (NO at Step S15). When the CPU 61 detects the selecting of the input key 252 (YES at Step S15), the CPU 61 determines whether or not the error that was detected at Step S12 is that the lower thread has run out (Step S16). In a case where the error that was detected at Step S12 is that the lower thread has run out (YES at Step S16), the CPU 61 sets the sewing time T to zero, then performs the processing at Step S18, which will be described later. In a case where the error that was detected at Step S12 is not that the lower thread has run out (NO at Step S16), the CPU 61 performs lower thread processing (Step S17).

Figure 7:
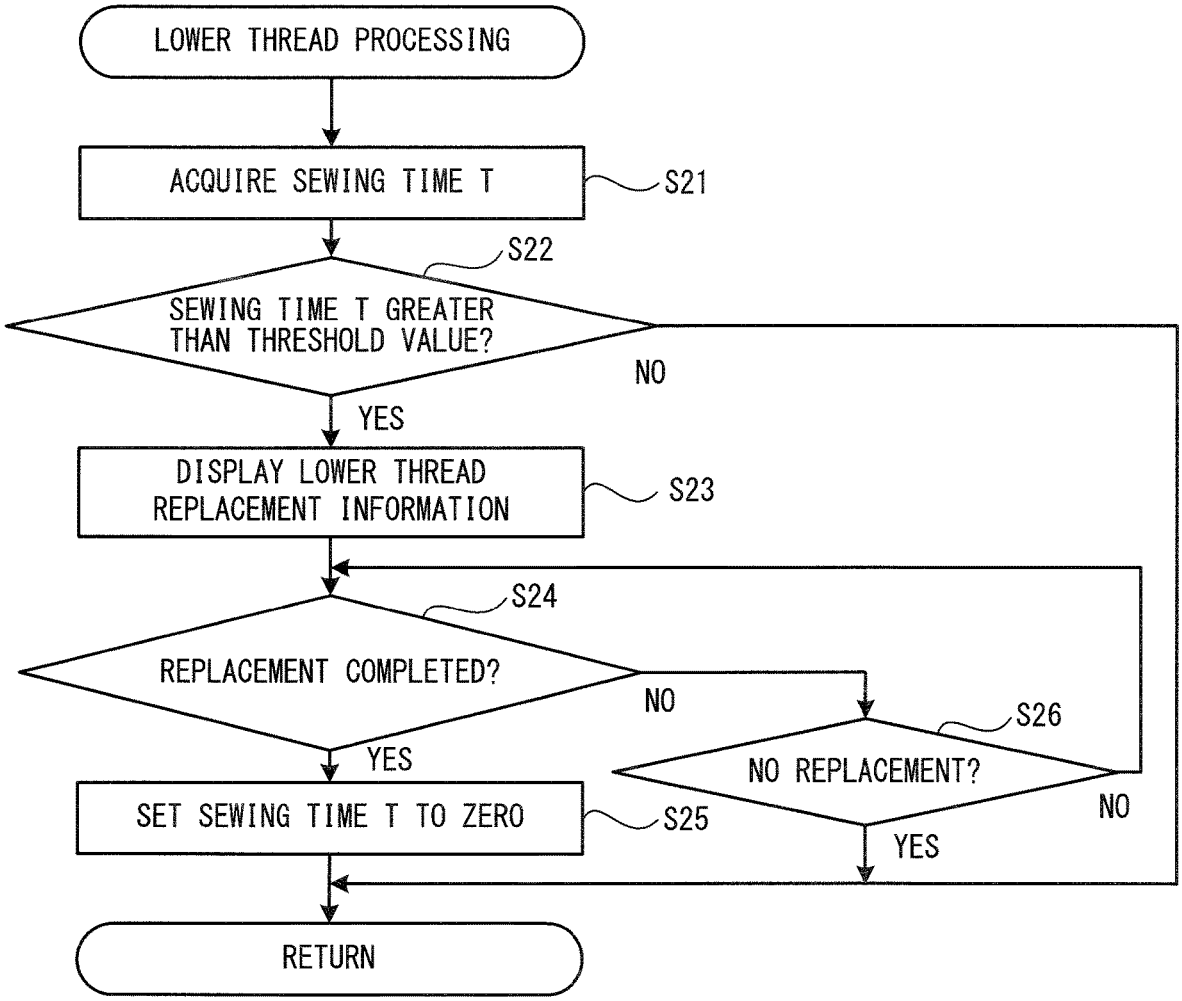
FIG. 7 is a flowchart of lower thread processing.
Figure 8:
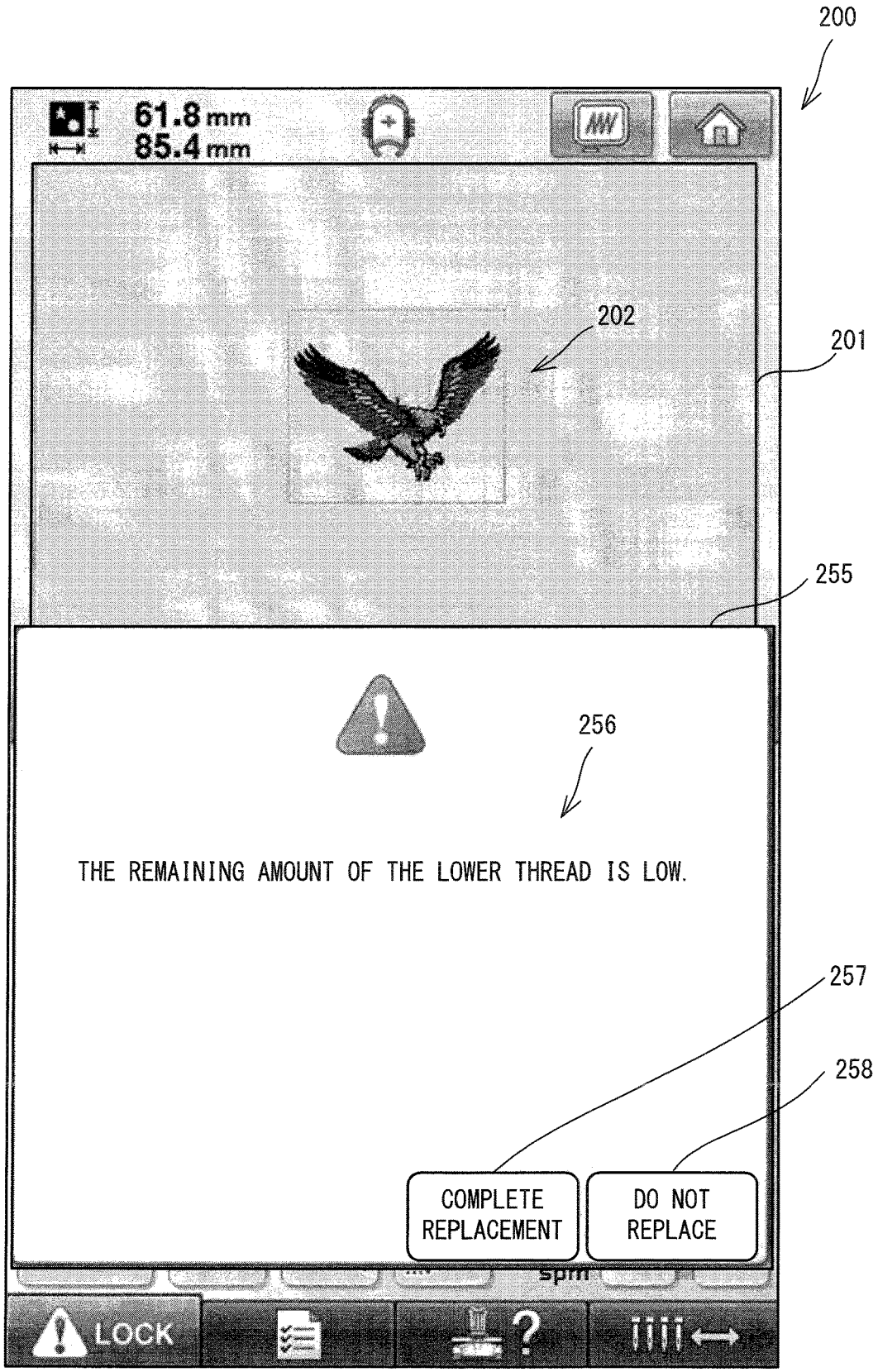
FIG. 8 is an explanatory figure of a screen.

In the lower thread processing, as shown in FIG. 7, the CPU 61 acquires the sewing time T from the EEPROM 64 (Step S21). The sewing time T is acquired as an indicator of the amount of the lower thread that is used in relation to the sewing. The CPU 61 determines whether or not the sewing time T that was acquired at Step S21 is greater than a threshold value (Step S22). The threshold value is set in advance, taking into consideration the length of the lower thread and the amount of the lower thread that is estimated to be used in the sewing time T. In a case where the sewing time T that was acquired at Step S21 is not greater than the threshold value (NO at Step S22), the CPU 61 terminates the lower thread processing and returns the processing to the main processing in FIG. 5.

In a case where the sewing time T that was acquired at Step S21 is greater than the threshold value (YES at Step S22), the CPU 61 causes the LCD 7 to display lower thread replacement information (Step S23). For example, the CPU 61 may cause the LCD 7 to display a screen 255 in FIG. 8 on the front face of the screen 200. The screen 255 includes a message area 256 and input keys 257, 258. The message area 256 displays information that indicates the amount of the lower thread that has been used. For example, "The remaining amount of the lower thread is low" may be displayed in the message area 256. The input key 257 is a key that issues a command to complete the replacement of the lower thread. The input key 258 is a key that issues a command to not replace the lower thread. The user checks the message that is displayed in the message area 256 and decides whether or not to replace the lower thread. After replacing or not replacing the lower thread as required, the user selects the corresponding one of the input key 257 and the input key 258.

The CPU 61 waits until the selecting of one of the input key 257 and the input key 258 has been detected (NO at Step S24; NO at Step S26). In a case where the selecting of the input key 257 has been detected (YES at Step S24), the CPU 61 sets the sewing time T to zero (Step S25). In a case where the selecting of the input key 258 has been detected (YES at Step S26), as well as after the processing at Step S25 is performed, the CPU 61 terminates the lower thread processing and returns the processing to the main processing in FIG. 5.

As shown in FIG. 5, following the processing at Step S17, the CPU 61 performs upper thread processing (Step S18). The upper thread processing is processing that, in response to the detecting of an error, notifies information that indicates a change-eligible needle bar. In the upper thread processing in the present example, the CPU 61 provides notification in the form of information that indicates the change-eligible needle bar in a case where a specified condition is satisfied. A case where the specified condition is satisfied is a case where the number of the change timings that have been set in one of the processing at Step S3 and a previous round of the processing at Step S18 is decreased by at least one by the setting of a new change timing while the sewing is stopped due to an error. In a case where, after the information that indicates the change-eligible needle bar has been provided, the user has input a command to set the change timing while the sewing is stopped due to an error, the CPU 61 sets the change timing while the sewing is stopped due to an error and updates the change timings that have already been set.

Figure 9:
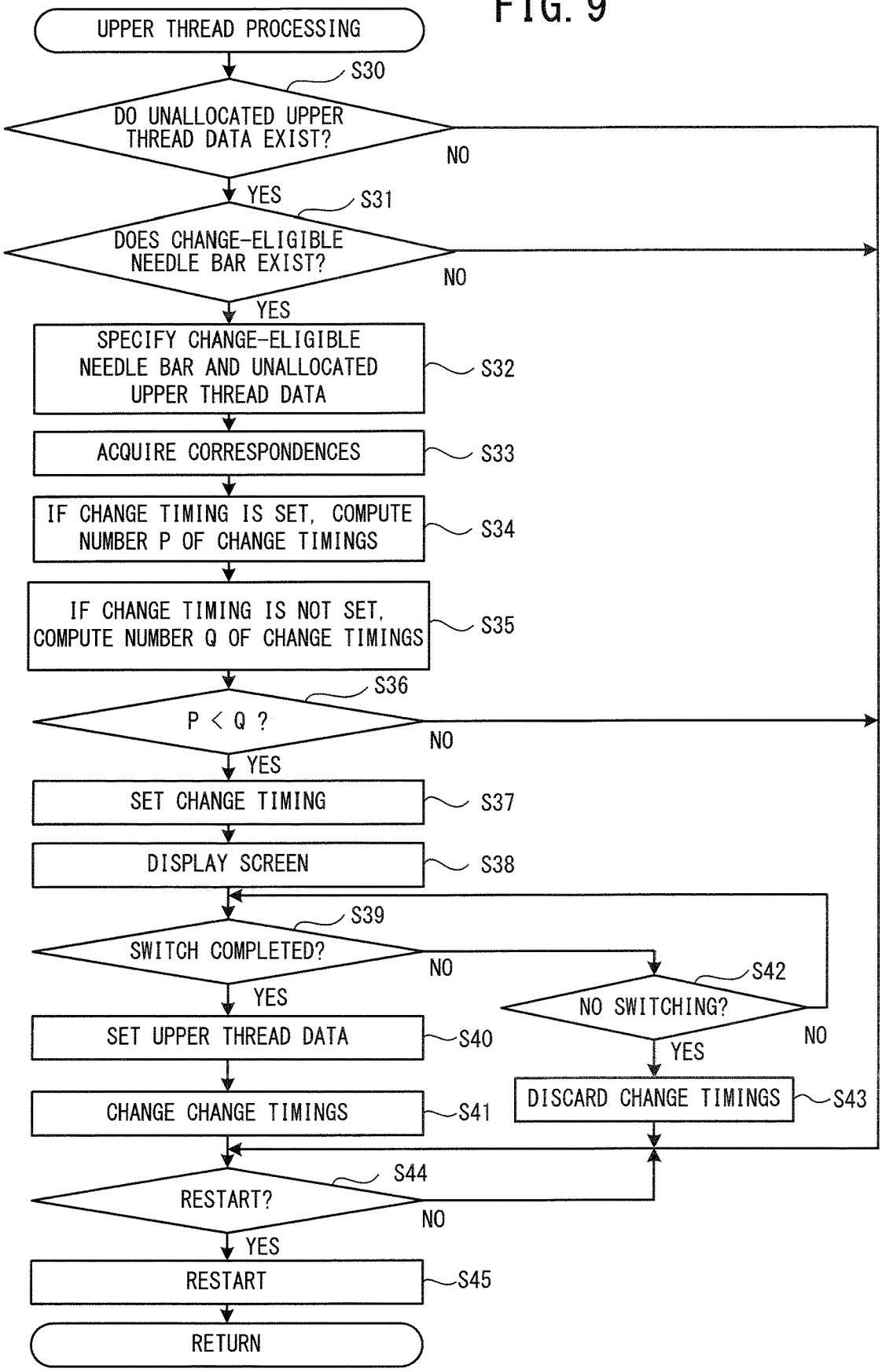
FIG. 9 is a flowchart of upper thread processing.

In the upper thread processing, as shown in FIG. 9, the CPU 61 determines whether or not any target data exist (Step S30). Among the upper thread data included in the sewing data that were acquired at Step S1, the target data are the upper thread data that have not yet been allocated to any one of the plurality of the needle bars 31. In other words, among the upper thread data included in the sewing data, the target data are the data that are that are not stored in the needle bar setting table 53. In a case where the target data do not exist (NO at Step S30), the CPU 61 performs the processing at Step S44, which will be described later. In a case where the variable N is a number from 1 to 6, as shown in the allocation table 52, the upper thread data sets that correspond to the partial patterns 7 to 9 in the sewing order are the target data (YES at Step S30), so the CPU 61 determines whether or not at least one of the change-eligible needle bar exists (Step S31). The change-eligible needle bar is one of the plurality of the needle bars 31 that has already been used in the sewing. In other words, the change-eligible needle bar is one of the needle bars 31 that is associated with a set of the upper thread data, among the upper thread data that are stored in the needle bar setting table 53, for which the sewing has already been completed. The change-eligible needle bar is one of the needle bars 31 for which the correspondence between the needle bar 31 and the upper thread data stored in the needle bar setting table 53 is eligible to be changed. In a case where the variable N is 1, the change-eligible needle bar does not exist (NO at Step S31). In that case, the CPU 61 performs the processing at Step S44, which will be described later.

In a case where the variable N is from 2 to 6, the change-eligible needle bar does exist (YES at Step S31). In that case, the CPU 61 specifies the change-eligible needle bar and the target data (Step S32). For example, in a case where the variable N is 4, the change-eligible needle bars are the needle bars 31 with the needle bar numbers 1 to 3. The target data are the upper thread data sets for the partial patterns 7 to 9 in the sewing order. The CPU 61 acquires the correspondences between the change-eligible needle bars and the target data sets (Step S33). In the present example, the CPU 61 acquires the correspondences between the change-eligible needle bars and the target data sets according to the allocation table 52 that was created at Step S2. For example, in a case where the variable N is 4, the individual needle bars 31 with the needle bar numbers 1 to 3 are respectively associated with the upper thread data (the target data) sets 7 to 9 in the sewing order. In a case where the variable N is one of 5 and 6, the number of the change-eligible needle bars is greater than the number of the target data sets. In those cases, there is at least one of the change-eligible needle bars with which none of the target data sets is associated. In a case where the variable N is one of 2 and 3, the number of the change-eligible needle bars is less than the number of the target data sets. In those cases, there is at least one of the target data sets that is not associated with one of the change-eligible needle bars.

The CPU 61 performs processing for determining whether or not the aforementioned specified condition has been satisfied. Specifically, the CPU 61 computes a number P of the change timings (Step S34). The number P of the change timings is the number of the change timings in a case where the change timing is set, and the correspondences between the needle bars 31 and the upper thread data sets are changed, while the sewing is stopped due to an error. The change timings that are set while the sewing is stopped due to an error are not included in the number P of the change timings. For example, in a case where the variable N is 4, if the upper threads 15 are switched for each one of the needle bars 31 with the needle bar numbers 1 to 3 while the sewing is stopped due to an error, the change timing CT (refer to FIG. 4) that was set at Step S3 becomes unnecessary. In other words, in a case where the variable N is 4, the number P of the change timings is zero. In the same manner, in a case where the variable N is one of 2 and 3, the number P of the change timings is 1. In a case where the variable N is any number from 4 to 6, the number P of the change timings is zero. The CPU 61 computes a number Q of the change timings (Step S35). The number Q of the change timings is the number of the change timings in a case where the change timing is not set while the sewing is stopped due to an error. In the present example, the change timings are set at Step S3, before the sewing is started, so the number Q of the change timings is the number of the change timings, among the change timings that have already been set, that have not been read at Step S4. In a case where the variable N is any number from 2 to 6, the number Q of the change timings is 1.

Figure 10:
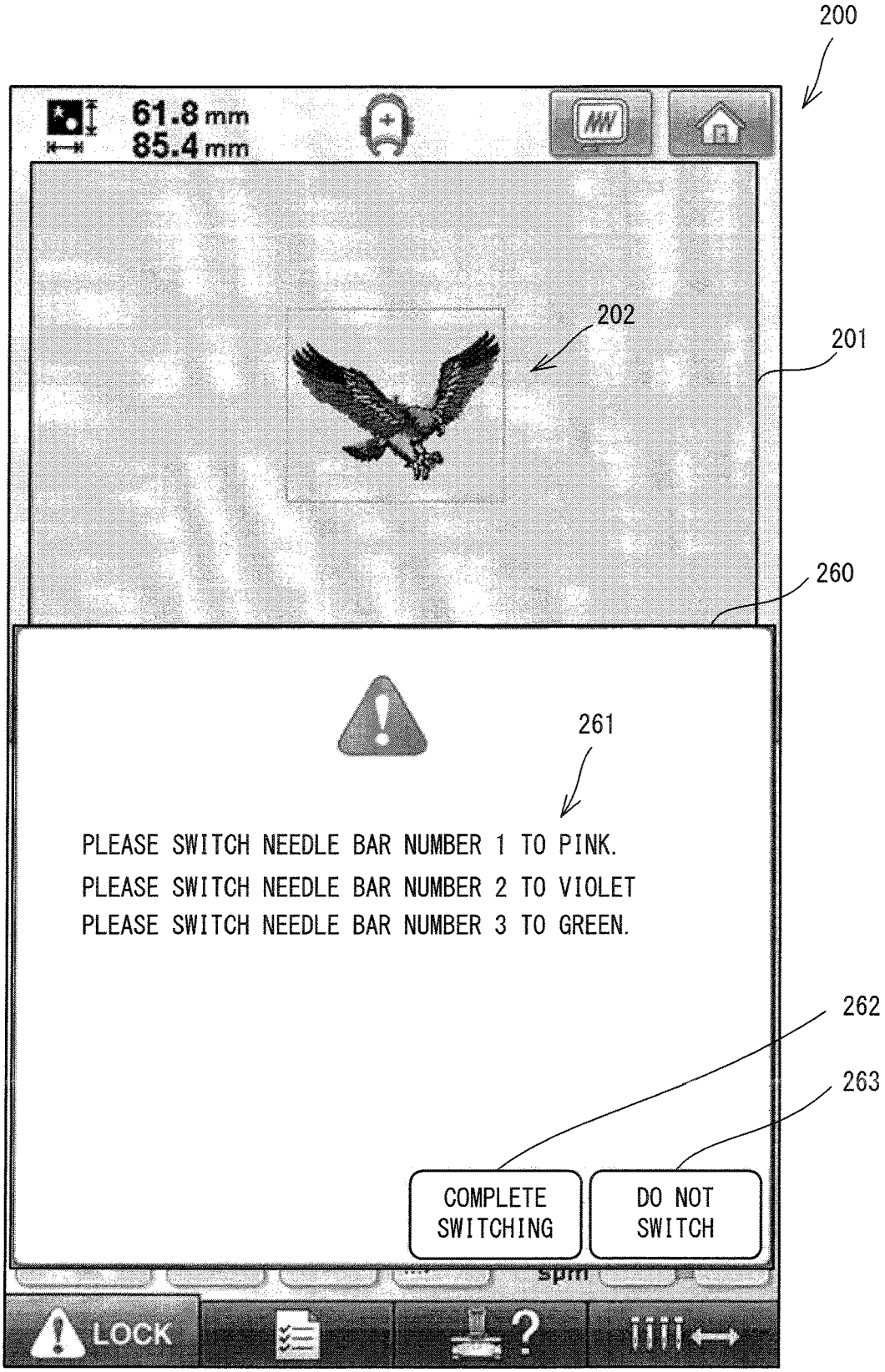
FIG. 10 is an explanatory figure of a screen.

The CPU 61 determines whether or not the number P that was computed at Step S34 is less than the number Q that was computed at Step S35 (Step S36). The processing at Step S36 is processing that determines whether or not the number of the change timings is less in a case where the change timing is set while the sewing is stopped due to an error and the change timings that were set at Step S3 are changed than in a case where the change timing is not set while the sewing is stopped due to an error. In a case where the variable N is one of 2 and 3, the number P is not less than the number Q (NO at Step S36). In that case, the CPU 61 performs the processing at Step S44, which will be described later. In a case where the variable N is a number from 4 to 6, the number P is less than the number Q (YES at Step S36). In that case, the CPU 61 sets the change timing while the sewing is stopped due to an error (Step S37). The CPU 61 causes the LCD 7 to display information that indicates the change-eligible needle bars that were specified at Step S32 and information that indicates the types of the upper threads 15 that are indicated by the target data (Step S38). For example, on the LCD 7, the CPU 61 may cause the LCD 7 to display a screen 260 that is shown in FIG. 10 on the front face of the screen 200. The screen 260 is provided with a message area 261 and input keys 262, 263. The correspondences between information that indicates the change-eligible needle bars and information that indicates the types of the upper threads 15 that are indicated by the upper thread data are displayed in the message area 261. In the present example, the information that indicates the change-eligible needle bars is the needle bar numbers. The information that indicates the types of the upper threads 15 is the color of the upper thread 15. In the present example, the correspondences between the change-eligible needle bars and the types of the upper threads 15 that are displayed in the message area 261 are based on the allocation table 52. The change-eligible needle bars with which none of the target data sets are associated are not displayed in the message area 261. The input key 262 is a key that issues a command to complete the switching of the upper threads 15 in accordance with the message that is displayed in the message area 261. The command that is input by the input key 262 is acquired as a command that changes the change timings that were set at Step S3. The input key 263 is a key that issues a command to not perform the switching of the upper threads 15.

The CPU 61 waits until the selecting of one of the input key 262 and the input key 263 has been detected (NO at Step S39; NO at Step S42). In a case where the selecting of the input key 262 has been detected (YES at Step S39), the CPU 61 sets the needle bar setting table 53 (Step S40). Specifically, in the needle bar setting table 53 in FIG. 4, the CPU 61 takes the upper thread data sets that correspond to the needle bar numbers 1 to 3 and replaces them with the upper thread data sets for the partial patterns 7 to 9 in the sewing order. The needle bar setting table 53 is set in the manner of a needle bar setting table 54. The CPU 61 changes the change timings based on the change-eligible needle bars and the target data that were specified at Step S32 (Step S41). The CPU 61 sets the change timing while the sewing is stopped due to an error and resets the subsequent change timings. In the present example, the setting of the change timing while the sewing is stopped due to an error makes the change timing CT unnecessary. Therefore, in the present example, the CPU 61 updates the change timings by deleting the change tinting CT, which has become unnecessary.

In a case where the selecting of the input key 263 has been detected (NO at Step S39; YES at Step S42), the CPU 61, without changing the needle bar setting table 54 and without updating the change timings, discards the change timing that was set at Step S37 while the sewing is stopped due to an error (Step S43). Following Step S41 and Step S43, the CPU 61 determines whether or not the start/stop switch 41 has been pressed to input a command to restart the sewing (Step S44). The CPU 61 waits until the command to restart the sewing is detected (NO at Step S44). In a case where the CPU 61 has acquired the command to restart the sewing (YES at Step S44), the CPU 61 restarts the sewing of the N-th partial pattern (Step S45). The CPU 61 restarts the processing that updates, at the specified intervals, the sewing time T that is stored in the EEPROM 64. The CPU 61 terminates the upper thread processing and returns the processing to the main processing in FIG. 5.

As shown in FIG. 5, following Step S18, the CPU 61 determines whether or not the sewing of the N-th partial pattern has been completed (Step S19). In a case where the sewing of the N-th partial pattern has not been completed (NO at Step S19), the CPU 61 returns the processing to Step S12. In a case where the sewing of the N-th partial pattern has been completed (YES at Step S19), the CPU 61 determines whether or not the sewing of all of the partial patterns has been completed (Step S20). In a case where at least one of the partial patterns has not been sewn (NO at Step S20), the CPU 61 increments the variable N by 1 and returns the processing to Step S4.

In a case where the variable N reaches 7 without an error having occurred during the sewing, it is determined at Step S4 that the current time has reached the change timing CT (YES at Step S4). In the same manner as at Step S32 in FIG. 9, the CPU 61 specifies the change-eligible needle bar and the target data at the change timing CT (Step S5). On the LCD 7, the CPU 61 causes LCD 7 to display information that indicates the change-eligible needle bar that was specified at Step S5, as well as information that indicates the type of the upper thread 15 that is indicated by the target data (Step S6). The CPU 61 causes the LCD 7 to display the same sort of screen as the screen 260 in FIG. 10. At Step S6, the CPU 61 causes the LCD 7 to display the message area 261 and the input key 262, but not to display the input key 263. The user switches the upper thread 15 in accordance with the message and selects the input key 262. The CPU 61 waits until the command to complete the switching of the upper thread 15 is acquired (NO at Step S7). In a case where the command to complete the switching of the upper thread 15 has been acquired (YES at Step S7), the CPU 61, in accordance with the allocation table 52, sets the upper thread data included in the sewing data for each of the plurality of the needle bars 31 (Step S8). The processing at Step S8 takes the upper thread data sets that are associated with the needle bars 31 with the needle bar numbers 1 to 3 in the needle bar setting table 53 and changes them to match the settings in the needle bar setting table 54. After Step S8, the CPU 61 performs the processing at Step S10, which was described previously. In a case where all of the partial patterns have been sewn (YES at Step S20), the CPU 61 terminates the main processing.

According to the sewing machine 1, when the sewing machine 1 has detected an error, the user is able to specify the change-eligible needle bar based on the information on the LCD 7. Based on the change-eligible needle bar for Which the LCD 7 has provided notification, the user, in responding to the error, is able to choose whether or not to switch the upper thread 15. If, in responding to the error, the user switches the upper thread 15, it is possible that the number of times that the switching of the upper thread 15 is performed for the sewing machine 1 will decrease. If, in responding to the error, the user switches the upper thread 15, it is possible to decrease the number of the upper threads 15 that are replaced at any one time and to distribute the work of switching the upper threads 15, without increasing the number of times that the sewing machine 1 is stopped solely in order to switch the upper thread 15. The sewing machine 1 is therefore able to make it more convenient for the user to sew an embroidery pattern that is sewn using a plurality of types of the upper threads 15.

According to the sewing machine 1, the user is able to check, on the LCD 7, the change-eligible needle bar and the type of the upper thread 15 that is indicated by the target data. In responding to the error, the user is able to choose whether or not to switch the type of the upper thread 15 that is supplied to the change-eligible needle bar to the type of the upper thread 15 for which the LCD 7 has provided notification. The sewing machine 1 is therefore able to make it more convenient for the user to sew an embroidery pattern that is sewn using a plurality of types of the upper threads 15.

According to the sewing machine 1, the user is able to specify the change-eligible needle bar at the change timing, based on the notification on the LCD 7. The user is able to use the LCD 7 to specify the needle bars 31 for which it is necessary to switch the upper threads 15. The sewing machine 1 is able to change the change timing in accordance with a command. If, in responding to the error, the user switches the upper thread 15, based on the notification on the LCD 7, and inputs a command, the change timing can be changed automatically to match the switching of the upper thread 15. In a case where, in response to the switching of the upper thread 15, a notification according to a change timing that was set in advance becomes unnecessary, the sewing machine 1 is able to avoid making the unnecessary notification.

According to the sewing machine 1, the user is notified of the change-eligible needle bar only in a case where the number of the change timings will be decreased if the upper thread 15 is switched in response to an error. Based on whether or not the LCD 7 notifies the user of the change-eligible needle bar, the user is able to determine whether or not the number of the change timings will be decreased. In a case where the user has switched the upper thread 15 in accordance with the information in the notification on the LCD 7, the user is able to switch the upper thread 15 in response to the error, while taking into consideration the fact that the number of the change timings will be decreased.

According to the sewing machine 1, after the sewing machine 1 has ceased to provide an error notification, because the user has responded to the error, for example, the user is able to check the change-eligible needle bar on the LCD 7. The sewing machine 1 is able to give priority to responding to an error. After the user has responded to the error, the user can choose whether or not to switch the upper thread 15 by taking into consideration factors such as the effort and time required, for example.

The sewing machine 1 makes it possible for the user, in responding to the detection of an error, to know, based on information on the LCD 7, approximately how much of the lower thread is remaining. In responding to the error, the user can choose whether or not to replace the lower thread, based on the information in the notification on the LCD 7. If, in responding to the error, the user replaces the lower thread for which the usable amount has become low, the user is able to avoid a situation in which the lower thread runs out comparatively soon after the sewing is restarted, forcing the sewing machine 1 to stop. The sewing machine 1 is therefore able to make it more convenient for the user to sew an embroidery pattern that is sewn using a plurality of types of the upper threads 15.

The sewing machine and a non-transitory computer-readable medium of the present disclosure are not limited to the embodiment that is described above, and various types of modification can be made within the scope of the present disclosure. For example, the modifications (A) to (C) below may be made as desired.

(A) The sewing machine 1 needs only to be a sewing machine that is provided with a plurality of needle bars, and the number and the arrangement of the needle bars may be modified. A notification portion needs only to be capable of notifying information, and it may be a display device other than an LCD, such as an LED or the like, a speaker, or the like.

(B) The programs that perform the processing in FIGS. 4, 6, 7, and 9 may be stored in a storage device of the sewing machine 1 until the sewing machine 1 executes the programs. Therefore, the method for acquiring the programs, the route by which the programs are acquired, and the individual devices that store the programs may all be modified as desired. The programs that a processor of the sewing machine 1 executes may be received from another device through a cable or by wireless communication and may be stored in a storage device such as a flash memory or the like. The other device may also be a PC, for example, and it may also be a server that is connected to the sewing machine 1 through a network.

(C) The individual steps in the processing in FIGS. 4, 6, 7, and 9 are not limited to being performed by the CPU 61, and some or all of them may also be performed by another electronic device (for example, an ASIC). The individual steps in the processing that is described above may also be performed by distributed processing by a plurality of electronic devices (for example, a plurality of CPUs). Where necessary, the individual steps in the processing in FIGS. 4, 6, 7, and 9 in the embodiment that is described above can also be performed in a different order, and steps can also be omitted and added. The functions in the embodiment that is described above may also be implemented by having an operating system (OS) or the like that runs in the sewing machine 1 perform some or all of the actual processing, based on commands from the CPU 61 of the sewing machine 1. Such a case is also within the scope of the present disclosure. For example, the modifications described under (C-1) to (C-5) below may be applied to the main processing as desired.

(C-1) The change-eligible needle bar needs only to be a needle bar whose sewing is completed. Consider, for example, a case in which a specific upper thread is used frequently. In a case where a function exists that prohibits any change to the correspondence between the upper thread data and the needle bar, the CPU 61 may specify a needle bar as a prohibited needle bar, for which any change to the correspondence with the upper thread data is prohibited. It is then acceptable for the CPU 61 not to specify the prohibited needle bar as a change-eligible needle bar, even if the sewing by the prohibited needle bar is completed. That makes it possible to reliably avoid any change to a needle bar that is specified as a prohibited needle bar. In a case where the number of the change-eligible needle bars is greater than the number of the target data sets, the CPU 61 may give priority to the needle bars for which the number of stitches is low and associate the target data sets with those needle bars, as in Japanese Laid-Open Patent Publication No. 2011-167446, relevant portions of which are herein incorporated by reference. In a case where an upper thread of a particular type is used for a plurality of partial patterns at different points in the sewing order, it may happen that even though one of the partial patterns has been sewn, another one of the partial patterns has not yet been sewn. In a case where the upper thread data are set for the needle bar in this manner, it is acceptable for the CPU 61 not to specify the needle bar as a change-eligible needle bar, even though it is a needle bar for which the sewing is completed. This eliminates the user effort that would be required in order to repeatedly mount the same type of upper thread on the sewing machine 1. The processing at Step S8 that sets the correspondence between the needle bar and the upper thread data may also be performed before the upper thread is switched.

(C-2) It is acceptable for the CPU 61 not to allocate the target data to the needle bars at Step S2. In that case, the CPU 61 may allocate the target data to the change-eligible needle bars at the change timing. The processing at Step S3 that sets the change timing may be omitted where necessary. In that case, the CPU 61, by referring to the needle bar setting table 53, may determine whether or not the N-th partial pattern can be sewn using one of the plurality of the needle bars 31. In a case where the N-th partial pattern cannot be sewn, a message that prompts the user to switch the upper thread 15 may be displayed on the LCD 7. In a case where the change timing is set at Step S3, the processing at Step S41 in FIG. 9 that updates the change timing may be omitted.

(C-3) In a case where the change-eligible needle bar and the target data are specified in the processing in FIG. 9, information that indicates the change-eligible needle bar may be displayed regardless of the relationship between the number P and the number Q. In that case, the processing at Steps S34 to S36 may be omitted. The CPU 61 may also omit the processing at Steps S42 and S43 in FIG. 9, such that the switching of the upper thread 15 is definitely done while the sewing is stopped due to an error. In the processing in FIG. 9, the CPU 61 may accept changes to the correspondences between the needle bars and the upper thread data sets for some of the change-eligible needle bars that are displayed at Step S38.

(C-4) In the processing at Steps S6 and S38, it is sufficient for information to be displayed that is able to specify at least the change-eligible needle bar. The information that is able to specify the change-eligible needle bar may be modified as desired in accordance with the type of the notification portion. For example, in a case where the notification portion is a plurality of LEDs that are disposed in positions that correspond to the individual thread spools 13 on the thread spool holder 12, the CPU 61 may cause the LED that corresponds to the change-eligible needle bar to turn on or to flash. In a case where the notification portion is the LCD 7, the form of the display of the change-eligible needle bar in the upper thread display area 203 may be different from the form of the display of the needle bars 31 that are not the change-eligible needle bar. For example, the form of the display may be a background color, the presence or absence of flashing, the color of the text characters, or the like. In the processing at Steps S6 and S38, in a case where the notification includes information that indicates the type of the upper thread, the information that can specify the type of the upper thread may be modified as desired in accordance with the type of the notification portion. In a case where the notification portion is the LCD 7, the CPU 61 may use a color display in the upper thread display area 203 to display the color of the upper thread that is associated with the change-eligible needle bar.

(C-5) The lower thread processing at Step S17 may be omitted as desired, and the user may be enabled to choose whether or not the lower thread processing will be performed. Information that indicates the amount of the lower thread that is used may also be information other than the sewing time T, such as the number of stitches or the like, and an electrical signal may also be output from the lower thread sensor 37.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

a plurality of needle bars;

a notification portion;

a processor; and a memory configured to store computer-readable instructions that, when executed by the processor, instruct the processor to perform processes comprising:

acquiring sewing data for sewing an embroidery pattern that is made up of a plurality of partial patterns, the sewing data including a plurality of upper thread data sets specifying types of upper threads associated with individual ones of the plurality of the partial patterns, setting correspondences between a needle bar from among the plurality of the needle bars and an upper thread data set included in the acquired sewing data, for each of the plurality of the needle bars, sewing each of the plurality of the partial patterns on a workpiece by operating, from among the plurality of the needle bars, a needle bar for which the correspondence with the upper thread data set is set, detecting an error that occurs during the sewing of each of the plurality of the partial patterns, stopping the sewing of a partial pattern being sewn in response to the error being detected, specifying a change-eligible needle bar, which is one of the plurality of the needle bars and for which the sewing is completed, in a situation in which a target data set exists among the plurality of the upper thread data sets included in the sewing data, the correspondence with one of the plurality of the needle bars not being set for the target data set, and causing the notification portion to notify information that indicates the specified change-eligible needle bar in response to the error being detected, wherein the specifying of the change-eligible needle bar includes specifying the target data set and the change-eligible needle bar in a situation in which the target data set exists, the causing of the notification portion to notify the information that indicates the change-eligible needle bar includes causing the notification portion to notify information that indicates the specified change-eligible needle bar and information that indicates a type of an upper thread indicated by the target data set, the computer-readable instructions further instruct the processor to perform processes comprising:

setting, in a situation in which the target data set exists, at least one change timing for changing the correspondences, while the sewing of the embroidery pattern is in progress, specifying the change-eligible needle bar for each of the at least one change timing, causing the notification portion to notify information that indicates the specified change-eligible needle bar for the at least one change timing that is set, and acquiring a command, in response to the error being detected, to change the at least one change timing that is set, and the setting of the at least one change timing includes changing the at least one change timing in response to the command being acquired, based on the specified change-eligible needle bar and the specified target data set, and the setting of the correspondences includes changing the correspondences at the at least one change timing, based on the specified change-eligible needle bar and the specified target data set.

2. The sewing machine according to claim 1, wherein the computer-readable instructions further instruct the processor to perform processes comprising:

determining, in response to the error being detected, whether the number of the at least one change timing is less in a situation in which the at least one change timing is to be changed than in a situation in which the at least one change timing is not to be changed, based on the specified change-eligible needle bar and the specified target data set, and the causing of the notification portion to notify the information that indicates the change-eligible needle bar includes causing the notification portion to notify information that indicates the specified change-eligible needle bar in a situation in which the number of the at least one change timing is less in a situation in which the at least one change timing is to be changed than in a situation in which the at least one change timing is not to be changed.

3. The sewing machine according to claim 1, wherein the computer-readable instructions further instruct the processor to perform processes comprising causing the notification portion to notify error information that indicates that an error is occurred for as long as the error is being detected, and the causing of the notification portion to notify the information that indicates the change-eligible needle bar includes causing the notification portion to notify information that indicates the specified change-eligible needle bar after notifying the information that indicates that an error is occurred is to be terminated.

4. The sewing machine according to claim 1, wherein the computer-readable instructions further instruct the processor to perform processes comprising:

acquiring an amount of a lower thread that is used by sewing in response to the error being detected, and causing the notification portion to notify information that indicates the amount of the lower thread that is used, in response to the acquired amount being is-less than a specified value.

5. A non-transitory computer-readable medium storing computer-readable instructions that are executed by a processor of a sewing machine provided with a plurality of needle bars and a notification portion, the computer-readable instructions, when executed, instructing the processor to perform processes comprising:

acquiring sewing data for sewing an embroidery pattern that is made up of a plurality of partial patterns, the sewing data including a plurality of upper thread data sets specifying types of upper threads associated with individual ones of the plurality of the partial patterns, setting correspondences between a needle bar from among the plurality of the needle bars and an upper thread data set included in the acquired sewing data, for each of the plurality of the needle bars, sewing each of the plurality of the partial patterns on a workpiece by operating, from among the plurality of the needle bars, a needle bar for which the correspondence with the upper thread data set is set, detecting an error that occurs during the sewing of each of the plurality of the partial patterns, stopping the sewing of a partial pattern being sewn in response to the error being detected, specifying a change-eligible needle bar, which is one of the plurality of the needle bars and for which the sewing is completed, in a situation in which a target data set exists among the plurality of the upper thread data sets included in the sewing data, the correspondence with one of the plurality of the needle bars not being set for the target data set, and causing the notification portion to notify information that indicates the specified change-eligible needle bar in a situation in which the error is detected, wherein the specifying of the change-eligible needle bar includes specifying the target data set and the change-eligible needle bar in a situation in which the target data set exists, the causing of the notification portion to notify the information that indicates the change-eligible needle bar includes causing the notification portion to notify information that indicates the specified change-eligible needle bar and information that indicates a type of an upper thread indicated by the target data set, the computer-readable instructions further instruct the processor to perform processes comprising:

setting, in a situation in which the target data set exists, at least one change timing for changing the correspondences, while the sewing of the embroidery pattern is in progress, specifying the change-eligible needle bar for each of the at least one change timing, causing the notification portion to notify information that indicates the specified change-eligible needle bar for the at least one change timing that is set, and acquiring a command, in response to the detecting of the error, to change the at least one change timing that is set, and the setting of the at least one change timing includes changing the at least one change timing in response to the command being acquired, based on the specified change-eligible needle bar and the specified target data set, and the setting of the correspondences includes changing the correspondences at the at least one change timing, based on the specified change-eligible needle bar and the specified target data set.

6. The sewing machine according to claim 5, wherein the computer-readable instructions further instruct the processor to perform processes comprising:

determining, in response to the error being detected, whether the number of the at least one change timing is less in a situation in which the at least one change timing is to be changed than in a situation in which the at least one change timing is not to be changed, based on the specified change-eligible needle bar and the specified target data set, and the causing of the notification portion to notify the information that indicates the change-eligible needle bar includes causing the notification portion to notify information that indicates the specified change-eligible needle bar in a situation in which the number of the at least one change timing is less in a situation in which the at least one change timing is to be changed than in a situation in which the at least one change timing is not to be changed.

7. The sewing machine according to claim 5, wherein the computer-readable instructions further instruct the processor to perform processes comprising causing the notification portion to notify information that indicates that an error has occurred for as long as the error is being detected, and the causing of the notification portion to notify the information that indicates the change-eligible needle bar includes causing the notification portion to notify information that indicates the specified change-eligible needle bar after notifying the information that indicates that an error is occurred is to be terminated.

8. The sewing machine according to claim 5, wherein the computer-readable instructions further instruct the processor to perform processes comprising:

acquiring an amount of a lower thread that is used by sewing in response to the error being detected, and causing the notification portion to notify information that indicates the amount of the lower thread that is used, in response to the acquired amount being less than a specified value.

9. A sewing machine comprising:

a plurality of needle bars;

a notification portion;

a processor; and a memory configured to store computer-readable instructions that, when executed by the processor, instruct the processor to perform processes comprising:

acquiring sewing data for sewing an embroidery pattern that is made up of a plurality of partial patterns, the sewing data including a plurality of upper thread data sets specifying types of upper threads associated with individual ones of the plurality of the partial patterns, setting correspondences between a needle bar from among the plurality of the needle bars and an upper thread data set included in the acquired sewing data, for each of the plurality of the needle bars, sewing each of the plurality of the partial patterns on a workpiece by operating, from among the plurality of the needle bars, a needle bar for which the correspondence with the upper thread data set is set, detecting an error that occurs during the sewing of each of the plurality of the partial patterns, stopping the sewing of a partial pattern being sewn in response to the error being detected, specifying a change-eligible needle bar, which is one of the plurality of the needle bars and for which the sewing is completed, in a situation in which a target data set exists among the plurality of the upper thread data sets included in the sewing data, the correspondence with one of the plurality of the needle bars not being set for the target data set, causing the notification portion to notify information that indicates the specified change-eligible needle bar in response to the error being detected, acquiring an amount of a lower thread that is used by sewing in response to the error being detected, and causing the notification portion to notify information that indicates the amount of the lower thread that is used, in response to the acquired amount is less than a specified value.

10. The sewing machine according to claim 9, wherein the specifying of the change-eligible needle bar includes specifying the target data set and the change-eligible needle bar in a situation in which the target data set exists, and the causing of the notification portion to notify the information that indicates the change-eligible needle bar includes causing the notification portion to notify information that indicates the specified change-eligible needle bar and information that indicates a type of an upper thread indicated by the target data set.

11. The sewing machine according to claim 10, wherein the computer-readable instructions further instruct the processor to perform processes comprising:

setting, in a situation in which the target data set exists, at least one change timing for changing the correspondences, while the sewing of the embroidery pattern is in progress, specifying the change-eligible needle bar for each of the at least one change timing, causing the notification portion to notify information that indicates the specified change-eligible needle bar for the at least one change timing that is set, and acquiring a command, in response to the detecting of the error, to change the at least one change timing that is set, and the setting of the at least one change timing includes changing the at least one change timing in response to the command being acquired, based on the specified change-eligible needle bar and the specified target data set, and the setting of the correspondences includes changing the correspondences at the at least one change timing, based on the specified change-eligible needle bar and the specified target data set.

12. The sewing machine according to claim 11, wherein the computer-readable instructions further instruct the processor to perform processes comprising:

determining, in response to the error being detected, whether the number of the at least one change timing is less in a situation in which the at least one change timing is to be changed than in a situation in which the at least one change timing is not to be changed, based on the specified change-eligible needle bar and the specified target data set, and the causing of the notification portion to notify the information that indicates the change-eligible needle bar includes causing the notification portion to notify information that indicates the specified change-eligible needle bar in a situation in which the number of the at least one change timing is less in a situation in which the at least one change timing is to be changed than in a situation in which the at least one change timing is not to be changed.

13. The sewing machine according to claim 9, wherein the computer-readable instructions further instruct the processor to perform processes comprising causing the notification portion to notify error information that indicates that an error is occurred for as long as the error is being detected, and the causing of the notification portion to notify the information that indicates the change-eligible needle bar includes causing the notification portion to notify information that indicates the specified change-eligible needle bar after notifying the information that indicates that an error is occurred is to be terminated.

* * * * *